US005608914A

United States Patent [19]

Keesler

[11] Patent Number: 5,608,914

[45] Date of Patent: Mar. 11, 1997

[54] HEADCOVER

[76] Inventor: Daren Keesler, 1147 E. 4975 South, Ogden, Utah 84405

[21] Appl. No.: 342,600

[22] Filed: Nov. 21, 1994

[51] Int. Cl.[6] ..... A42B 1/04

[52] U.S. Cl. ..... 2/207; 2/171; 2/174

[58] Field of Search ..... 2/171, 172, 174, 2/175.1, 195.1, 195.2, 195.7, 207; 132/273, 274

[56] References Cited

U.S. PATENT DOCUMENTS 2,765,473 10/1956 Doyle ..... 2/207

3,298,035 1/1967 Gobins ..... 2/174

*Primary Examiner*—Diana Biefeld

[57] ABSTRACT

A headcover for a human head that has an isosceles triangular shaped first fabric material and with the base of a smaller isosceles shaped supple fabric sewn to the first fabric material such that the smaller triangle is sewn to and centered on the base of the first fabric material, darts sewn into edges of the first fabric material to cause said material to fold along lines extending from the darts to the peak of the smaller isosceles triangle as the peak of the first fabric material is folded to pass between a resilient ring on the first fabric material and the back of the head of a user of the headcover.

2 Claims, 2 Drawing Sheets

HEADCOVER

BRIEF DESCRIPTION OF THE INVENTION

1. Field of the Invention

This invention relates to headcovers and is particularly concerned with hats of the type generally made from bandanas.

2. Prior Art

It has long been recognized that a hat or headcover can, be made from a folded and tied bandana. Such headcovers have frequently become associated with pirates, motorcycle riders and others. The headcovers, while inexpensively made, are sometimes difficult to make properly fit a user's head and may easily come-apart while in use.

OBJECTS OF THE INVENTION

It is a principal object the present invention to provide a hat or headcover that, while having the general appearance of a headcover made from a folded and tied bandanna, will better maintain the general shape while being easily adjusted to fit a particular user's head.

Another object is to provide a headcover that will maintain an upright shape at the front of the headcover to thereby provide a consistent and desirable appearance.

FEATURES OF THE INVENTION

Principal features of the invention include an isosceles triangle shaped fabric sheet, folded intermediate its base to form overlapping identical right angle triangles and with the fold serving as the long leg of each right angle triangle. Another supple fabric, stiffer than the material of the fabric sheet, is formed as an isosceles triangle, has its base centrally sewn to the base of the fabric sheet and its sides sewn to the fabric sheet such that the peak of the supple fabric is in the line of fold when the fabric sheet is folded to form overlapping identical right triangles. The supple material thus serves as a backing for a portion of the fabric sheet. Darts folded into the hyotenuse legs of the folded fabric sheet are angled to point towards the peak of the supple backing and the darts are sewn together.

An elastic ring is provided to snugly encircle and to be adjustably positioned along the portions of fabric sheet extending from the darts to the ends of the short leg of each right angle triangle. The positioning of the ring determines the size of the headcover opening that will accomodate a use's head. The portion of the fabric sheet defined by the fold, between the tip of the supple fabric and the hypotenuse edges of the fabric sheet folds at the darts and along the lines formed from the darts to the peak of the supple fabric so that the junction of the hypotenuse edges passes between the elastic ring, the darts and a use's head, to be held in place.

Additional objects and features of the invention will become apparent from the following detailed description and drawing, disclosing what is presently contemplated as being the best mode of the invention.

THE DRAWINGS

DETAILED DESCRIPTION OF THE INVENTION

Figure 1:
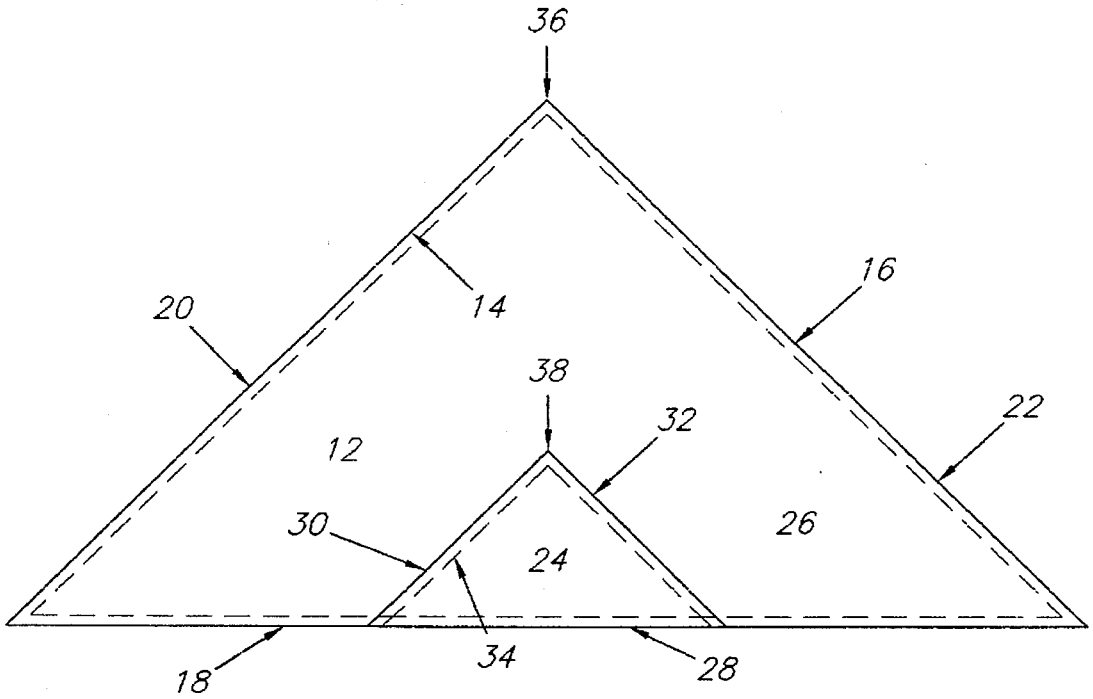
FIG. 1 is a top plan view of the isosceles triangle shaped fabric sheet of the invention with the isosceles triangle shaped supple fabric attached thereto.
Figure 2:
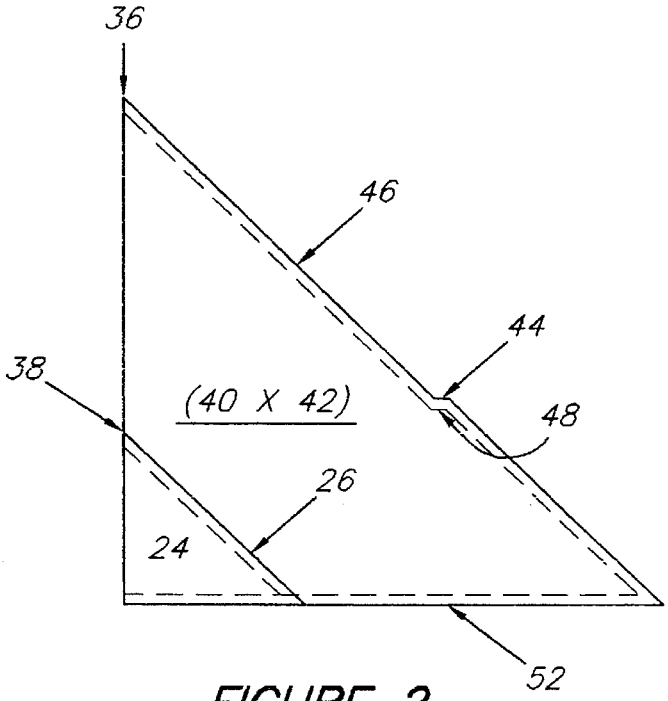
FIG. 2 is a similar view of the fabric sheet and supple fabric attachment folded through the central axis of the fabric sheet and the supple fabric.
Figure 3:
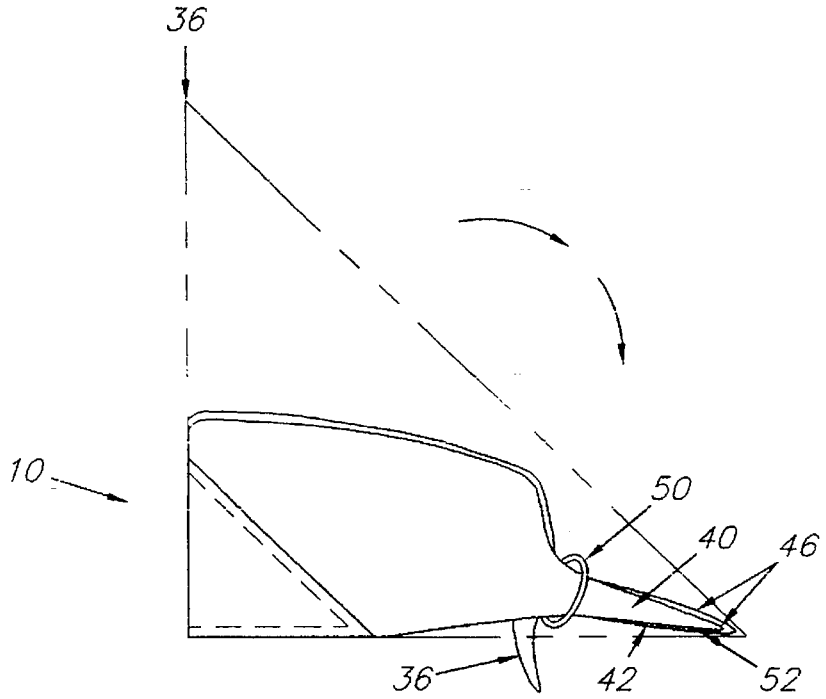
FIG. 3 is a view like that of FIG. 2 but further including a resilient ring around trailing corners of the fabric sheet and with a peak corner of the fabric sheet folded to pass beneath the elastic ring.
Figure 4:
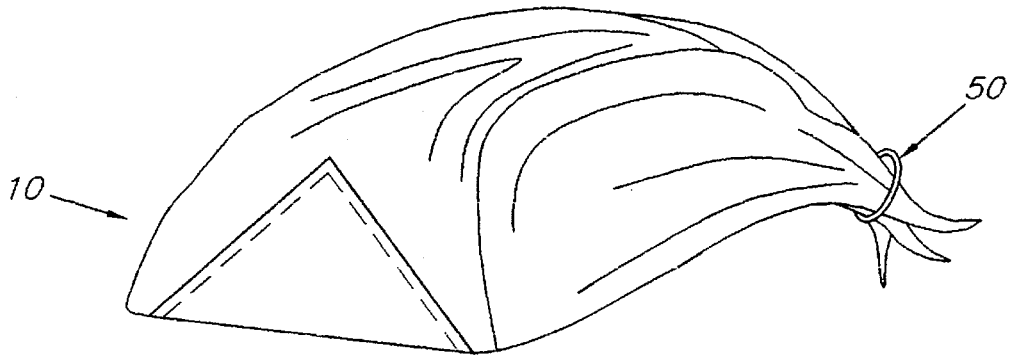
FIG. 4, a perspective view of the headcover, taken from above and to the front side of the headcover.

Referring now to the drawings:

In the illustrated preferred embodiment the headcover of the invention is shown generally at 10. Headcover 10 includes a fabric sheet 12, hemmed at 14 around its edge, and having the shape of an isosceles triangle 16, with a base 18 arid equal length sides 20 and 22. Another supple material 24 is formed as a shoal let isosceles triangle 26, with a base 28 arid equal length sides 30 and 32. The base 28 of triangle 26 is positioned centrally on base 18 of triangle 16, with the triangle 26 extending into and overlying the triangle 16. The triangle 26 is sewn at 34 around its edge to the fabric sheet 12.

The fabric sheet 12 and supple material 24 are folded centrally through their bases 18 and 28 and common peak 36 and 38 to form overlying right angle triangles 40 and 42.

A dart 44 is formed intermediate the length of the hypotenuse edge 46 of each of the triangles 40 and 42 and the darts are sewn together at 48, such that the darts are pointing in the general direction of the peak 38 of the triangle 26. The darts 44 cause the fabric sheet 12 of both right angle triangles 40 and 42 to fold in the general direction of the peak of the triangle 26 during use of the headcover 10. The location of the darts is determined by folding the peak of isosceles triangle 16 towards and past the base of that triangle between two and one-half and three inches while maintaining the fold line parallel to the base. The darts are then positioned at the ends of the fold line.

A resilient ring 50 surrounds and tightly grips portions of triangles 40 and 42 between the base edges 52 and the hypotenuse edges 46. The positioning of the ring 50 and particularly the distance of the ring from the base center of the triangle 26 determines the size of the headcover 10 and by changing the distance from the base center of triangle 26 to the resilient ring 50 a user can adapt the headcover 10 to any desired head size.

In use the ring 50 is positioned to size the headcover. The portions of the triangles 40 and 42 extending from the darts 44 to the uppermost peaks of the triangles 40 and 42 are folded such that the peak 36 passes between the back of a user's head (not shown) and the resilient ring 50.

Although a preferred form of my invention has been herein disclosed it is to be understood that the present disclosure is by way of example and that variations are possible without departing from the subject matter coming within the scope of the following claims, which subject matter I regard as my invention.

I claim:

1. A headcover comprising an isosceles triangle shaped fabric sheet having a peak and an edge opposite the peak forming a base of the said isosceles triangle shaped fabric sheet;

a smaller isosceles triangle formed of a supple material having a peak and having one edge forming a base of the said smaller isosceles triangle and sewn to said isosceles triangle shaped fabric sheet with the base of the smaller isosceles triangle centered on the base edge of said isosceles triangle shaped fabric sheet;

a pair of hypotenuse edges formed in the fabric sheet when said fabric sheet is folded to bisect said base edge of said isosceles triangle shaped fabric sheet and to form right angle triangles;

a dart formed in each said hypotenuse edge means securing said darts together; and a resilient ring adjustably securing the fabric sheet between said hypotenuse edges and said base edge of the fabric sheet to provide sizing for said headcover and wherein a peak of said isosceles triangle shaped fabric sheet is inserted between said ring and said means securing said darts together at the back of a head of a user of said headcover.

2. A headcover as in claim 1, wherein said darts are sewn together and each dart points towards the peak of said smaller isosceles triangle.

* * * * *